US005156531A

United States Patent [19]

Schmid et al.

[11] Patent Number: 5,156,531

[45] Date of Patent: Oct. 20, 1992

[54] RADIAL PISTON PUMP

[75] Inventors: Peter Schmid, Waldstetten; Günter Pannek, Böbingen/Rems; Klaus Weckbrodt, Heubach/Lautern; Michael Reichenmiller, Waldstretten, all of Fed. Rep. of Germany

[73] Assignee: Zahnradfabrik Friedrichshafen, AG., Friedrichshafen, Fed. Rep. of Germany

[21] Appl. No.: 640,366

[22] PCT Filed: Sep. 12, 1989

[86] PCT No.: PCT/EP89/01057

§ 371 Date: Jan. 29, 1991

§ 102(e) Date: Jan. 29, 1991

[87] PCT Pub. No.: WO90/02876

PCT Pub. Date: Mar. 22, 1990

[30] Foreign Application Priority Data

Sep. 15, 1988 [DE] Fed. Rep. of Germany ..... 3831319
Mar. 18, 1989 [DE] Fed. Rep. of Germany ..... 3908916

[51] Int. Cl.[5] ..... F04B 49/00; F04B 1/04
[52] U.S. Cl. ..... 417/295; 417/273
[58] Field of Search ..... 417/285, 292, 295, 273

[56] References Cited

U.S. PATENT DOCUMENTS 3,994,358 11/1976 Smitley ..... 417/295
4,662,825 5/1987 Djordjevic ..... 417/295
4,968,220 11/1990 Filippi et al. ..... 417/273
4,990,065 2/1991 Otaki ..... 417/273

*Primary Examiner*—Richard A. Bertsch
*Assistant Examiner*—Alfred Basichas
*Attorney, Agent, or Firm*—Albert M. Zalkind

[57] ABSTRACT

This invention relates to a radial piston pump in whose suction bore (22) a load regulator (24) is inserted. The pump is to be regulated so that a constant stream and, as required, a variable large regulating stream will be available. For this purpose, a spool valve (26) that can be activated electromagnetically is inserted in a bore (23) that intersects the suction bore (22) and that spool valve can establish a connection to a suction duct (28) that is connected to a cam chamber (14) to make the regulating stream available by means of a collar (33). From suction bore (22) there furthermore branches off a shutter bore (34) that is likewise connected to the cam chamber (14) via a ring groove (35) and additional bores (36) in the pump housing (3). Shutter bore (34) limits the constant stream. The regulating stream is supplied to a consumer with fluctuating power consumption, for example, a hydrofan, that is powered with an rpm proportional to the cooling water temperature. The constant stream is used to supply, for example, a level regulation and lubricating stream. The load regulator (24) as well as the oil guides (bores, ducts, ring grooves) are machined into a cover (2).

11 Claims, 4 Drawing Sheets

RADIAL PISTON PUMP

BACKGROUND OF THE INVENTION

A radial piston pump with a load regulator, inserted in a suction bore, is known already from German Published Patent Application 3734928. This load regulator includes a rotary piston which, when it is in its terminal position, releases a maximum through-flow, cross-section. When the load regulator is turned in the direction toward the other terminal position, the through-flow cross-section is diminished until a minimum value is reached. The load regulator is adjusted from the outside by means of an adjusting drive. The installation of a load regulator makes it possible to adapt the output of a radial piston pump with high accuracy to the requirements of a consumer with greatly fluctuating power consumption, for example, a hydromotor for powering the fan in motor vehicles. During actual driving operation, this results in an output saving reduced fuel consumption. This known arrangement, however, does not work in a fully satisfactory manner as regards the uniform filling of the conveyor cylinders, especially in the lower regulating range, when there is partial filling. As a result of uneven filling, pressure pulsations and noise are increased in radial piston pumps due to the specific design and type involved.

The purpose of the invention is to design the radial piston pump so that it will be able to supply the oil needed by one or more consumers over the broadest possible regulating range. Here, it should be possible to maintain uniform filling of all conveyor cylinders in case of any momentary conveying volume. This requirement is to be implemented with the least possible structural effort and only minor changes in the outside dimensions of the pump.

SUMMARY OF THE INVENTION

According to the invention, the conveyor stream in the suction bore is divided into a regulating stream and a comparatively small constant stream, whereby the sum of both streams is available for the consumers at the pump outlet. As the load regulator for the regulating stream, an inexpensive electromagnetically adjustable valve member, such as a piston slide, is installed in the suction bore. This regulating stream is available to the hydromotor of a cooling fan, and possibly, also to other consumers, over a broad span, for example, 0.3 to 10.0 $dm^3$/min, as required. The constant stream of 0.3 $dm^3$/min, for example, is used to supply a level regulation and as a lubricating stream. In this way, one can achieve a suction stream regulator for the main consumer that will depend on the requirement and that will thus save energy while the constant minimum stream required for level regulation is available at any time.

The valve member of the load regulator is guided in a borehole that intersects the suction bore, whereby this bore ends in a suction duct that runs parallel to the suction bore and that is connected to the conveyor pistons of the pump.

The valve member has a closing member for the supply of the regulating stream at its free end, facing toward the suction duct, while the suction bore, furthermore, is constantly connected to the conveyor pistons via a flow resistor borehole for the constant stream. This special arrangement facilitates a space-saving division of the conveyor stream.

The advantageous position of the valve member immediately on the cam chamber creates short current travel paths to the conveyor pistons and thus also quiet conveyor operation.

The valve member can be made as a piston slide or as a seat valve. To ensure the supply by means of the pump at any time, the valve member always releases the largest regulation cross section in case of any possible stream failure.

The space-saving housing of the load regulator is further promoted by virtue of the fact that the regulator is inserted radially with respect to the drive shaft in a housing lid.

The narrow bore for the constant stream communicates with a ring groove that is provided in the front of the housing lid and that ends in the cam chamber via several bores. The volume capacity of the ring groove is so selected that it will be filled up by the constant stream. As a result, uniform distribution of the pressure oil over the entire circumference of the cam chamber into which the conveyor pistons dip to pick up oil can be achieved. During operation, when only the constant stream is available to the pump, one thus also gets uniform partial filling of the conveyor pistons. As a result, the pump will run more quietly.

The suction duct—which can be connected to the suction bore via the valve member—is connected with the cam chamber via a ring groove and via openings in the housing lid that are distributed uniformly over the circumference. As a result, the pressure oil flows uniformly into the cam chamber below the conveyor pistons. It is advantageous to select the openings, which are located below the middle of the housing lid when the pump is in the built-in position, to be smaller than the openings above the middle of the lid. This makes it possible to prevent too much oil from flowing off via the ring groove to the subjacent conveyor pistons and to prevent a situation where the conveyor pistons, located further upward along the circumference, will not be filled sufficiently. The features mentioned here on the one hand enable us to ensure the adequate charging of the conveyor pistons when large regulating volumes have to be handled along with a high rpm; on the other hand, even in case of random regulating volumes, one can achieve the uniform partial filling of all conveyor pistons. This contributes to the aforementioned noise reduction.

One essential advantage of the invention consists in the fact that almost all bores and ducts, necessary for oil stream division and oil guidance on the suction side, can be machined into the housinq lid with little effort.

One can place bores that run axially from the ring groove that guides the constant stream to each cylinder bore. These bores are opened when the conveyor pistons are in the lower dead-center position so that the constant stream can be injected directly. This measure facilitates particularly uniform cylinder filling.

Because in a pump with an appropriately regulated output valve, a comparatively high suction underpressure can develop in the cam chamber, pressure relief of the installation space of a shaft sealing ring to the suction bore is provided. In this way, one can prevent outside air from being drawn in via the shaft sealing ring.

Another possibility is to relieve the pressure on the shaft sealing ring and to supply the cam chamber with a constant stream by connecting the suction bore via a bore in the pump housing with a ring groove in the installation space for the shaft sealing ring. Flow restrictor boreholes lead from the ring groove to the cam chamber. This design is advantageous if there is not enough room to house a ring groove in the lid.

BRIEF DESCRIPTION OF THE FIGURES

Other objects and advantages of the invention are explained in greater detail below in connection with the accompanying drawing, in which.

DETAILED DESCRIPTION

Figure 1:
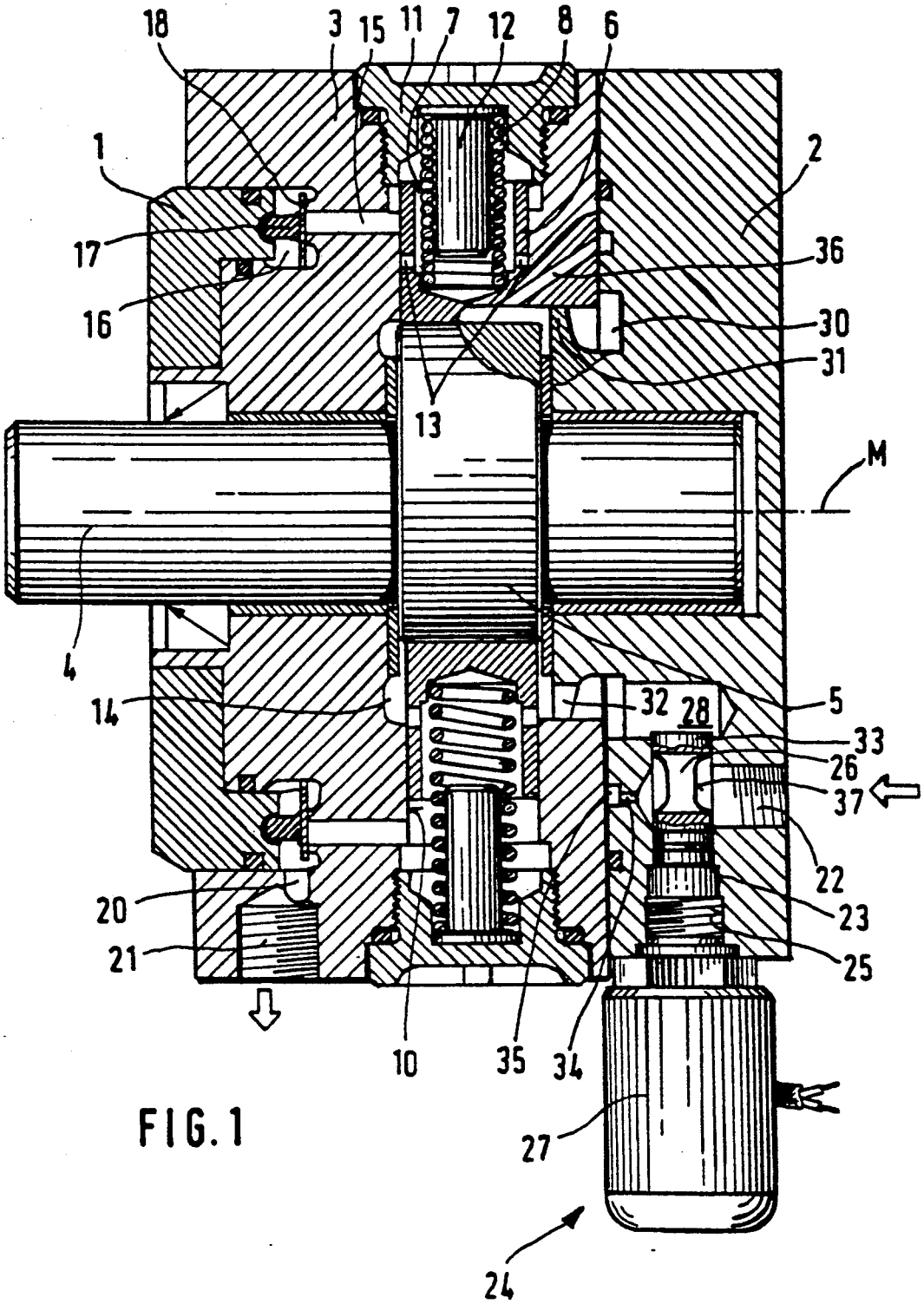
FIG. 1 is a simplified cross-section through a radial piston pump with a load regulating valve.

The pump according to FIG. 1 includes a housing 3, that is closed by means of covers 1 and 2 and that includes a shaft 4. Shaft 4 bears a cam 5 which, for example, causes six pump pistons 6, arranged in a star pattern with respect to the shaft, to perform a lifting motion in succession. A spring 8, braced in an inside chamber 7, keeps the pump pistons 6 resting against a circumferential surface of cam 5. Pump piston 6 moves in a cylindrical bore 10 that is closed off by a screw cap 11. Screw cap 11 at the same time serves to brace the spring 8 which is guided by a pin 12. Each pump piston 6 includes inlet openings 13 which, in case of a suction stroke, dip into a cam chamber 14. All inside chambers 7 of the pump pistons 6 can be made to communicate with a ring chamber 16 via pressure ducts 15. By way of an outlet valve, the ring chamber 16 contains a sealing disc 18 which is pressed against pressure ducts 15 by means of an elastic rubber ring 17. In place of the outlet valve shown, individual valves, for example, in the form of ball retaining valves may be provided. Ring chamber 16 leads via a bore 20 to an outlet connection 21 that is connected with the consumers.

According to the invention, a suction intake bore 22 connected with a tank (not illustrated) is provided in cover 2. A load regulator 24 is inserted into a bore 23 that perpendicularly intersects suction bore 22. This load regulator is screwed into a taphole 25 of the cover 2. Load regulator 24 essentially comprises a valve member made in the form of a spool valve 26 and an electromagnet 27 connected therewith.

Parallel to suction bore 22 lies a suction duct 28 that communicates with a ring groove 30 cast into the cover 2. Ring groove 30 again is connected to cam chamber 14 via several openings 32 that are distributed uniformly over the circumference of a baffle wall 31 that is integral with cover 2.

These openings 32 can—when in the built-in position below the middle M of horsing cover 2—be made smaller than the openings further upward.

Spool valve 26 at its free end has as a closing member a collar 33 that determines the regulating stream which flows from the suction bore 22 into suction duct 28 and which is then ready in the cam chamber 14 for drawing in by pump pistons 6. Suction duct 22 furthermore is connected with another ring groove 35 via a restrictor bore 34. This ring groove 35 is likewise connected to the cam chamber 14 via several oblique bores 36 in the housing 3 that lie between pump pistons 6. The restrictor bore 34 determines the constant stream that can flow at any time via the suction bore 22 and a construction 37 of spool valve 26. The oil that is suctioned in by the pump is thus divided, in suction bore 22, into two different suction streams that are united again in cam chamber 14.

Figure 2:
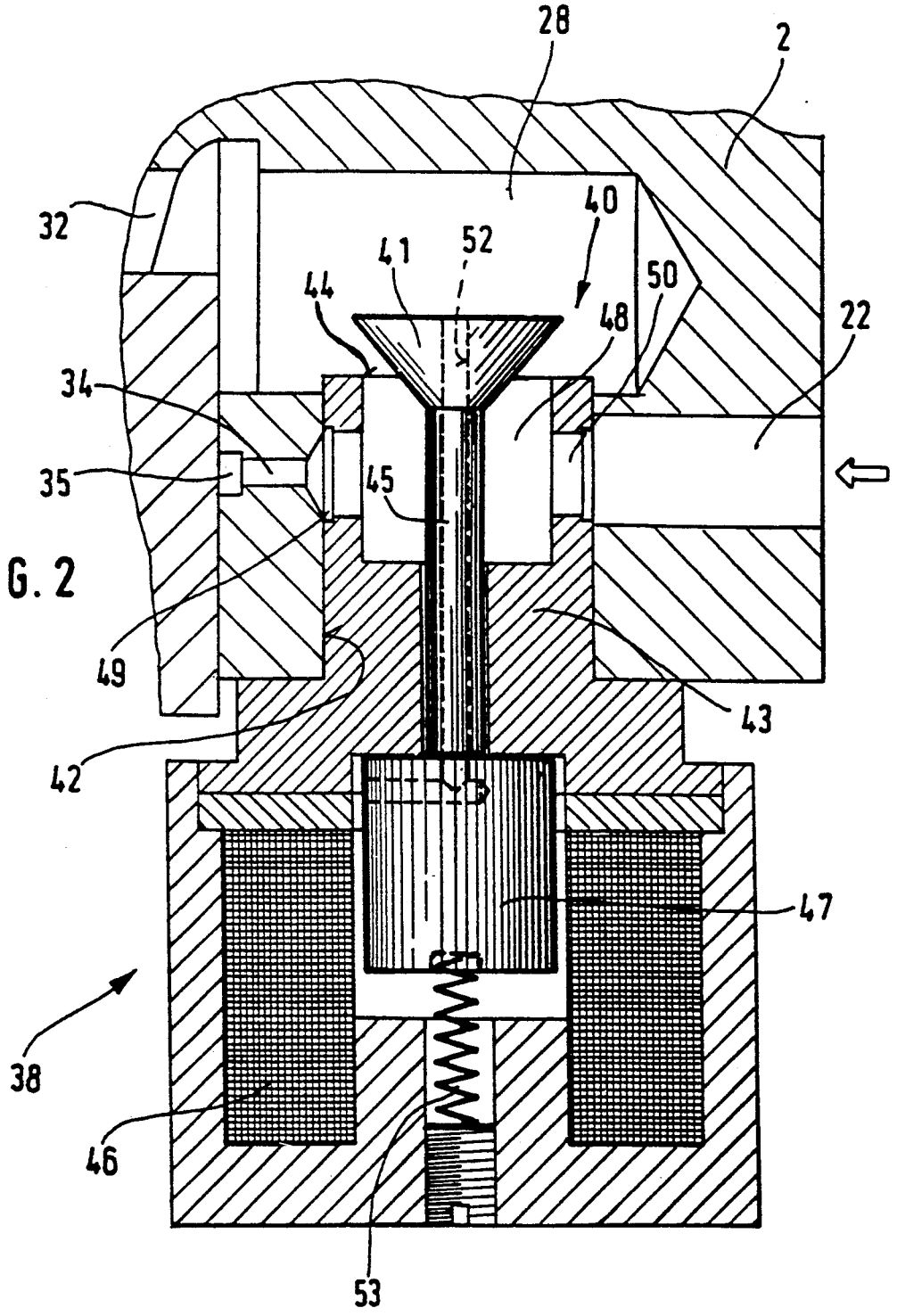
FIG. 2 is an enlarged cross-section in a greatly simplified illustration, featuring another embodiment of a load regulating valve.

In place of the load regulating valve 24 having a spool valve 26 as the valve member, one can provide also a load regulating valve 38 with a seat valve 40 as shown in FIG. 2. Here, the closing member comprises a valve cone 41 whose stem 45 is guided in a sleeve 43 inserted in a borehole 42 of cover 2. Valve cone 41 seals against a valve seat 44 of sleeve 43. Stem 45 carries an armature 47 that cooperates with a magnetic coil 46.

The pressure oil is supplied into an inside chamber 48 from suction bore 22 via a ring duct 49 and several bores 50 of sleeve 43. The ring duct 49 furthermore communicates with the shutter bore 34 and the ring groove 35 for the constant stream. A balancing bore 52 provides a pressure equalization on both sides of the seat valve 40. In case of magnetic current failure, the suction pressure and a spring 53 press valve cone 41 into the opening position as shown so that unregulated consumer supply is then ensured.

Load regulating valves 24 or 38 can be selected via an electronic switching device (not shown) as a function of the cooling water temperature. Depending on the selection of electromagnet 27 (FIG. 1) or 46, 47 (FIG. 2), more or less oil will be flowing into the suction duct 28 or cam chamber 14 so that one gets a fan adjustment that will be proportional to the cooling water temperature.

The blocking position, shown in FIG. 1, in which the collar 33 closes bore 23, comes about when the magnet 27 is fully excited if the cooling water temperature is low. Pump pistons 6 can thus only draw in the constant stream determined by the restrictor bore 34 and that stream is available via the path of ring groove 35 and bores 36 in cam chamber 14. The oil requirement for level regulation can be covered at any time in this fashion. Besides, an adequate lubricating stream is available in the pump.

As soon as the cooling water temperature rises, the electrical current to the electromagnet 27 is reduced so that the spool valve 26 will move slightly into suction duct 28 as a result of the suction pressure and the spring force. In the process, collar 33 releases a corresponding regulation cross-section. The regulation stream that flows then drives the hydrofan with the appropriate rpm. In this way, the pump output can be adjusted to the particular cooling requirement. The constant stream for level regulation is not influenced by this.

When made as a seat valve according to FIG. 2, load regulating valve 38 works in a corresponding manner.

Figure 3:
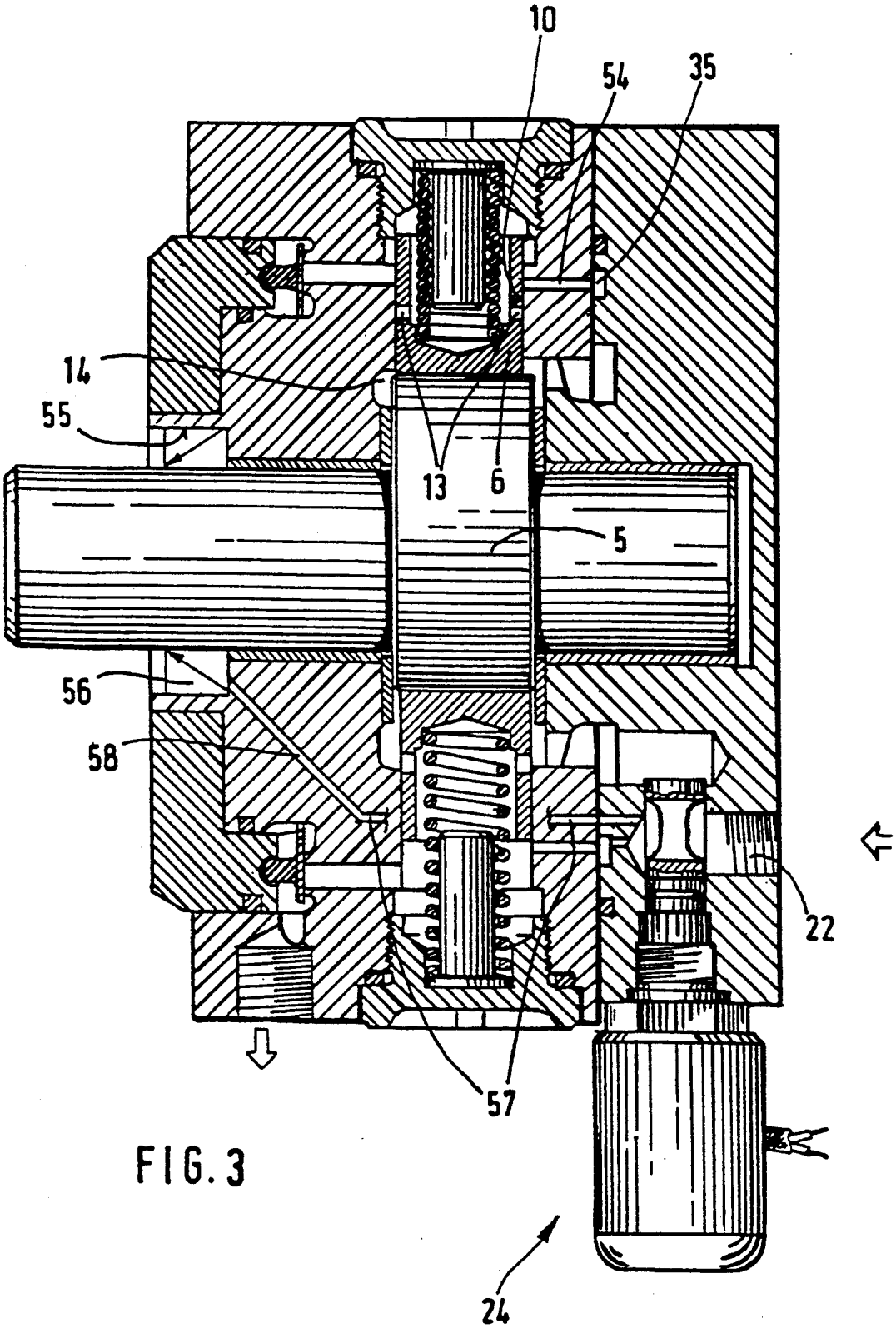
FIG. 3 is a cross-section through a radial piston pump according to FIG. 1 with a different constant stream guide pattern.

In FIG. 1, there are shown several bores 36 that are oriented obliquely and that lead into cam chamber 14, and that branch off from ring groove 35 for the purpose of distributing the constant stream. Alternatively, FIG. 3 shows axial bores 54 which, by way of substitution, lead into the cylinder bores 10. These bores 54 are opened completely when the pump pistons 6 are in the lower dead-center position (suction phase). The eccentricity of cam 5, the inlet bores 13, and bores 54 are so coordinated with each other that there cannot be any short-circuit between the bores 13 and 54. In other words, the constant stream can be supplied by means of "direct injection"—to achieve even more uniform cylinder filling. In this way, a very small constant stream volume (minimum stream) is obtained that is necessary to maintain the lubricating function, to prevent temperature shocks to the consumer, and for the possible supply of secondary consumers. Uniform filling causes a minor pressure pulsation and thus also a lower noise level.

In this arrangement, a relatively high suction underpressure can be generated in the cam chamber when load regulating valve 24 is appropriately adjusted. To make sure that no outside air is drawn in via a shaft sealing ring 56 and a sliding bearing, one relieves the pressure in an installation space 55 of the shaft sealing ring 56 via bores 57 and 58 going to suction bore 22.

Figure 4:
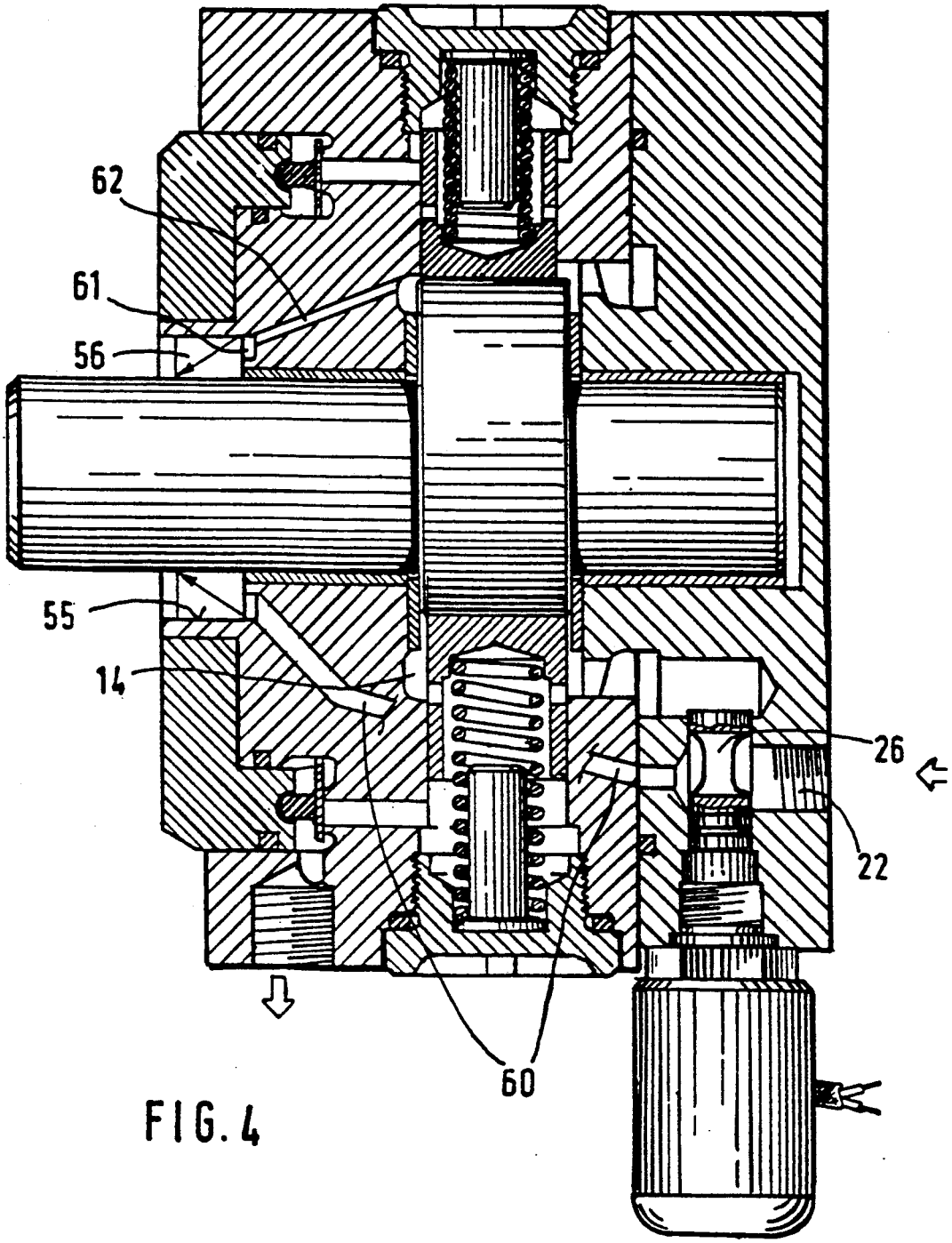
FIG. 4 illustrates another constant stream guide pattern, in a cross-section, according to FIGS. 1 and 3.

In the embodiment according to FIG. 4, suction bore 22 communicates via a bore 60 with a ring groove 61 of the insertion chamber 55 for the shaft sealing ring 56. Several shutter bores 62 that empty into cam chamber 14 branch off from this ring groove 61.

By virtue of their length and the narrow cross-section, the shutter bores deliver the desired constant stream. In this case, bore 60 is used to relieve pressure on the shaft sealing ring 56, and at the same time it serves as a "supplier" for the constant stream with the piston slide 26 properly adjusted.

It is within the context of the invention that radial piston pumps which, for example, have two groups of pistons, lying in two radial planes, for the supply of two consumer circuits one piston group can be provided with bores 54, including ring groove 35 (FIG. 3), and the other piston group can be provided with bores 60 or 62 (FIG. 4). In that case, the particular bore arrangements—looking at it in the axial direction—are in the forward pump part (shaft inlet) and in the rear pump part. Constant stream supply can thus be determined while considering the space availability conditions in the pump.

We claim:

1. In a radial piston pump including a housing (3), a drive shaft (4) arranged in the housing, a cam (5 mounted on the shaft for driving at least one piston (6) to draw an oil flow into a cam chamber (14) via a suction intake bore (22), the piston having inlet portion (13) which communicate with the cam chamber, and an output load regulator (24) arranged in the intake bore, the regulator including an adjustable valve (26) for altering the flowthrough cross-section to the piston in order to provide a regulating oil pressure stream in accordance with the power consumption of a consumer connected to the pump, the improvement which comprises (a) said piston (6) comprising a hollow piston containing a plurality of radial inlet ports (13) above and below a centerline (M) of the housing cover when the pump is in an installed position;

(b) means arranged within said suction bore for dividing the oil flow into the regulating oil pressure stream and a constant stream, said adjustable valve being arranged in a bore (23) which intersects the suction intake bore (22), said adjustable valve bore communicating with a suction duct (28) arranged parallel to the suction intake bore and connected with the cam chamber, said suction duct (28) being connected with the suction bore (22) via the adjustable valve and with the cam chamber (14) via an annular channel (30) and openings (32) in the housing cover (2) that are distributed uniformly over the circumference above and below the centerline (M), said openings which are below the centerline being smaller than said openings that are arranged above the centerline; and (c) a solenoid (27) connected with said housing for actuating the adjustable valve to control the regulating oil pressure stream through said suction duct, said channel, said openings, and into said piston via said inlet ports.

2. A radial piston pump as defined in claim 1, wherein said adjustable valve has a collar (33) at a free end thereof which faces the suction duct for the regulating oil pressure stream, the suction bore (22) communicating with the cam chamber via a flow restrictor bore (34) for the constant stream.

3. A radial piston pump as defined in claim 2, wherein the adjustable valve is located directly in the cam chamber.

4. A radial piston pump as defined in claim 1, wherein the adjustable valve comprises a spool valve.

5. A radial piston pump as defined in claim 1, wherein the adjustable valve comprises a seat valve (40).

6. A radial piston pump as defined in claim 1, wherein the adjustable valve of the output load regulator opens to the greatest regulating cross-section in case of power failure.

7. A radial piston pump as defined in claim 1, wherein said housing includes a cover (2), said output load regulator being mounted in said cover radially arranged with respect to the drive shaft.

8. A radial piston pump as defined in claim 2, wherein the flow restrictor bore for the constant stream communicates with an annular channel ring groove (35) in a housing cover (2), said ring groove (35) communicating with the cam chamber (14) via several slanted bores (36).

9. A radial piston pump, as defined in claim 8, wherein the annular channel ring groove (35) is connected with the flow restrictor bore (34) for the constant stream and with cylinder bores (10) of the pump pistons (6) via additional bores (54).

10. A radial piston pump as defined in claim 1, and further comprising a shaft sealing ring (56) arranged in an installation space (55) going to the suction intake bore (22) and a pressure-relieved via bores (57, 58).

11. A radial piston pump as defined in claim 8, wherein a bore (60) from the suction bore (22) leads to an annular channel ring groove (61) of the installation space, and further wherein said annular channel ring groove is connected with the cam chamber via a plurality of flow restrictor bores (62).

* * * * *